US005260859A

United States Patent [19]

Lettenmayer

[11] Patent Number: 5,260,859

[45] Date of Patent: Nov. 9, 1993

[54] LIGHTING UNIT FOR COLLINEAR DOUBLE ENDED TUBULAR LAMPS

[76] Inventor: Horst Lettenmayer, Korbinianstr 2, Munich, Fed. Rep. of Germany, D-8000

[21] Appl. No.: 272,675

[22] PCT Filed: Apr. 2, 1987

[86] PCT No.: PCT/EP87/00181

§ 371 Date: Nov. 30, 1989

§ 102(e) Date: Nov. 30, 1989

[87] PCT Pub. No.: WO87/06326

PCT Pub. Date: Oct. 22, 1987

[30] Foreign Application Priority Data

Apr. 7, 1986 [DE] Fed. Rep. of Germany ..... 3611630

[51] Int. Cl.[5] ..... F21S 3/00

[52] U.S. Cl. ..... 362/219; 362/226; 362/249; 439/239; 439/698

[58] Field of Search ..... 362/219, 226, 249; 439/235, 239, 698

[56] References Cited

U.S. PATENT DOCUMENTS

| | | | |
|---|---|---|---|
| 2,298,824 | 10/1942 | Darley | 362/219 |
| 4,158,221 | 6/1979 | Agabekov | 362/219 |
| 4,521,838 | 6/1985 | Agabekov | 362/219 |
| 4,723,199 | 2/1988 | Freed et al. | 439/239 |
| 4,874,320 | 10/1989 | Freed et al. | 439/239 |
| 5,027,262 | 6/1991 | Freed | 439/239 |

FOREIGN PATENT DOCUMENTS

| | | | |
|---|---|---|---|
| 331441 | 4/1903 | France . | |
| 603981 | 4/1960 | Italy | 362/219 |

*Primary Examiner*—Ira S. Lazarus
*Assistant Examiner*—L. Heyman
*Attorney, Agent, or Firm*—Townsend and Townsend Khourie and Crew

[57] ABSTRACT

An elongated strip light for use with low voltage, tubular lamps having conical end contacts. The lighting unit has an angle strip made of an insulating material to which a pair of electrically conductive tracks are mounted on the outside of the strip. A series of U-shaped, spaced-apart lamp holders are riveted to the inside of the angle strip. The rivets and the holders are arranged so that the holders are alternatingly electrically connected to one or the other electrically conductive track so that each pair of proximate holders mounted to the angle strip is of a different polarity. The holders further define resilient arms, each provided with a hole for receiving, holding and electrically connecting conical contact ends of the lamps with the holders to thereby energize the lamps when the conductive strips are connected to a source of electric power.

13 Claims, 3 Drawing Sheets

LIGHTING UNIT FOR COLLINEAR DOUBLE ENDED TUBULAR LAMPS

The invention relates to a lighting unit comprising double ended tubular lamps arranged in a row, an angle strip with two limbs arranged at an angle (α) to each other, conducting tracks, which are applied to at least one limb and respectively extend continuously in the longitudinal direction of the angle strips, and electrically conducting double ended tubular lamp holding elements, which are secured to the inner faces of the limbs by means of rivet joints, the rivet joints at the same time serving for the electrical connection between the respective conducting tracks and the holding elements and the holding elements have holes, in which the conically tapering contact ends of the double ended tubular lamps are held in place with the simultaneous supply of power thereto.

A lighting unit of this type has for example been described in the Swiss patent 599,501. For each double ended tubular lamp there are two respective holding elements, that is to say one for each end of the double ended tubular lamps and between such holding elements the double ended tubular lamps are fitted. Respectively adjacent holding elements are in this respect secured to different limbs of the angle strip. Thus, for each double ended tubular lamp it is necessary to have two holding elements, which have to be secured to the conducting tracks. In this case the conducting tracks are secured to the inner face of the limbs, that is to say directly adjacent to the double ended tubular lamps so that the latter heat up to a relatively high temperature owing to convention or radiation. The limbs, on which the conducting tracks are attached, are fashioned of a nonconducting, electrically insulating material, as for example plastic, whose thermal conductivity is very low so that the temperature, to which the metallic conducting tracks are heated, is only a little under the temperature of the double ended tubular lamps. Owing to the substantially different coefficients of thermal expansion of the metallic conducting tracks and of the insulating material of the limbs, to which the conducting tracks are rigidly secured, powerful mechanical stresses result, which cause a corrugation and warping of the lighting unit or may even result in fracture thereof. There is also the possibility of fracture of the connection between the metallic conducting track and the insulating limb material. At any event, the lighting unit is thermally instable owing to the heating effects, this more particularly being a reason for a substantial reduction in the reliability and working life of this known lighting unit.

Furthermore the patent publications WO-A-85/05433 and EP-A-0 126 023 describe lighting units in the form of an angle strip with double ended tubular lamps in the case of which again two respective holding elements are provided for each one double ended tubular lamps. The holding elements are in this case made integral with the conducting tracks, the holding elements being split off from the conducting tracks. The conducting track is in each case laid on the outer sides of the limbs and the holding elements project though a respective corresponding hole into the cavity inside the lighting unit. One disadvantage of this lighting unit is that the conducting tracks have their cross section considerably reduced where the holding elements are split off from the material of the conducting track. This means that the lighting unit may only be operated with a low amperage, this being more specially a considerable disadvantage since such lighting units are normally operated at a low voltage and in order to obtain sufficient wattage heavy amperages have to be used. Furthermore, in the case of the known lighting units it is a disadvantage that there are difficulties as regards adaptation to double ended tubular lamps with different lengths or diameters. For each type of double ended tubular lamp it is necessary to use special tools both for the production of the conducting tracks and also for the production of the angle strip in order to provide the conducting tracks with respective openings for the production of the holding elements and to provide the angle strip with suitable holes for the passage of the holding elements. Furthermore the production of such strips is elaborate, since stamping tools are needed for spliting off of the holding elements from the conducting tracks and it is necessary to stamp holes in the limbs both for the passage of the holding elements and also for attachment elements, such as rivets or the like.

The French patent 331,441 describes a lighting unit, in which there are to conductors, which extend in parallelism to the lighting unit. Furthermore the lighting unit has holding elements, which have two lugs for holding one respective end of two double ended tubular lamps, and which are secured in an insulating manner in a housing. Conducting wires lead from these holding elements to conductors extend in parallelism to the lighting unit. The individual holding elements for their part consist of different element parts, which are secured to each other by means of screws and are attached to further lamp parts. The manufacture of the individual parts of the holding element and fitting same are very slow and elaborate. Furthermore there has in addition to be a connecting conductor leading from each holding element to the conductors running in parallelism to the lighting unit, such conductors further increasing the complexity of manufacture and more especially they also impair the reliability of operation of this known lighting unit.

The U.S. Pat. No. 1,484,211 describes a lighting unit designed in the form of an angle strip with lamps, which is specially designed for lamps which are not described in detail and substantially occupy the full diameter of an o-like structure formed of side walls. Owing to this base for mounting the lamps the lamp space is split up into separate segments so that it is not possible for there to be an even illuminating effect along the lamp and in fact there will be dark parts where the sockets are located. Furthermore the sockets are very complex. The electrical leads are arranged within the three-sided part of a corner. As regards its individual parts this lighting arrangement is without any apparent advantage and is very elaborate and is not suitable as a design for the low-cost mass production of lamps.

Accordingly the object of the invention is create a lighting unit of the initially mentioned type which may be produced in the simplest possible manner, may be operated with maximum amperage for a given expenditure on material and in a simple manner may be adapted to different sizes of double ended tubular lamps.

In order to achieve this purpose the holding elements each have two resilient lugs, are respectively alternately electrically connected with one of the conducting tracks and one respective holding element serves for holding one respective end of two double ended tubular lamps and the conducting tracks are provided on the outer face of the limbs or, respectively, on the outer faces of the limbs.

Owing to the feature of the invention that the holding elements each have two resilient lugs for holding one respective end of two double ended tubular lamps it is possible for only one holding element to be provided on average for each double ended tubular lamp. This offers the advantage that the conducting tracks only have to be provided with a minimum number of openings or holes for the attachment of holding elements, as for example in the form of rivets, so that only a very small part of the material of the conducting tracks is lost and as a result the conductor cross section may be kept large, this making it possible for the lighting unit in accordance with the invention to be provided with substantially heavier amperages. Since the power is the product of amperage and voltage and in the low voltage range the voltage is limited to a relatively low maximum value, the lighting unit in accordance with the invention makes it possible to achieve high light intensities without further technical elaboration. A further advantage is that the manufacture is very simple, since only a relatively small number of holding elements have to be fixed in place. Additional measures for the attachment of conducting tracks are not required, since the attachment elements, as for example grooves, for the fixation of the holding elements simultaneously serve for the attachment of the conducting tracks as well on the limbs. Owing to the simple type of assembly and of the attachment of the individual elements due to the holding elements in accordance with the invention for holding one respective end of a pair of two double ended tubular lamps it is also possible to design angle strips in a simple manner in different dimensions of double ended tubular lamps. For longer double ended tubular lamps it is only necessary to increase the distances for the riveting of the holding elements with the limbs or, respectively, the conducting tracks. If double ended tubular lamps with a larger or a smaller diameter are used, it is only necessary to use other holding elements with suitably longer or shorter lugs.

In conjunction with other features of the invention it is more particularly an advantage as well if the conducting tracks are provided on the outer side or, respectively, outer sides of the limbs, since the electrically conducting material of the limbs, preferably a plastic and serves for the thermal insulation of the conducting tracks from the double ended tubular lamps. The conducting tracks are therefore substantially less heated than in a case in which they would be mounted on the limb sides facing the double ended tubular lamps. The danger of warping, of fracture or of detachment of the conducting tracks and/or of the angle strip material is thus substantially less so that the thermal and mechanical strength and thus reliability and length of life are increased. Furthermore the risk from conducting objects, for example, falling on the strip lighting unit causing shortcircuits is reduced, since the outer sides of the limbs are usually attached to walls or partitions and the like and are thus covered and protected.

The features of the invention thus lead to a very simple type of lighting unit, which dependent on the specific requirements may be cut off from running lengths and installed, as for instance for store windows, trailer or boat lighting, as rear lighting for stucco work and undercoatings, as indirect room lighting and handrail lighting, a set of shelving or showcase, as cupboard lighting, as mirror lighting or as suspended cupboard lighting for kitchens, for use in internal or external rooms etc. The user only needs to cut off a length of the lighting strip with the desired adaptation and to fix it in place and does not have to use finished lighting units with fixed dimensions.

The conducting tracks for the two electrical phases for the supply of the double ended tubular lamps are in accordance with one form of the invention mounted in a manner insulated from each other on one limb of the angle strip. It is however particularly advantageous to apply the two continuous conductors to separate limbs of the angle strip. This substantially cuts out the possibility of a shortcircuit or makes it unnecessary to provide insulation between the pairs of conductors in order to reliably prevent shortcircuits.

For the manufacture of the lighting unit in accordance with the invention it is an advantage if the holding elements are attached by means of at least one rivet joint on the limbs, the rivet connection at the same time forming the electrical connection between the respect conducting track and the holding element. The manufacture of such strip lighting units is thus extremely efficient and low in price.

Preferably the angle $\alpha$ is equal to 90°. Although the angle may be freely selected and in accordance with the specific requirements, it is in most cases an advantage if the angle is equal to 90°. As a basic principle it is also possible to have plain strip, that is to say not an angle strip. An angle strip does however lead to substantially stiffer and stronger lighting units, which more especially also have a pleasing appearance.

In accordance with a particularly preferred embodiment of the invention the lighting unit is in the form of an angled element for the connection of two edge elements placed at an angle to each other. It is in this manner that the lighting unit itself forms a structural or connecting element for the connection together of wall elements so that the lighting unit fulfills two functions, namely as a mechanical structural element on the one hand and as a lighting unit on the other. This combination is particularly advantageous, since now anyone may join together and produce the lighting unit in accordance with the invention in the simplest possible manner by the connection of wall, glass or mirror elements to make show cases, room configurations or containers of any desired size using the lighting unit in accordance with the invention, the angle element simultaneously serving as an illuminating means and is not only pleasing to the eye but furthermore is very efficient from the point of view of illumination engineering and makes possible the illumination of the assembled element or container. For a square or rectangular three dimensional element lighting units with an angle $\alpha$ of 90° are utilized, whereas for an octagonal three dimensional element lighting units having an angle element with an $\alpha$ angle of 135° may be used.

It is for example also possible to use glass, mirror or other walls with a zigzag form to make up multiple structures which are combined, the angle element serving as a mechanical connection being used in the invention as an illumination means.

A further form of the lighting unit in accordance with the invention is possible in which at or in the vicinity of the angle ends means are provided for attachment of a transparent cover strip. The attachment means may be example include grooves, in which the cover strips are slipped, but it is also possible to use clip or detent means. By using a transparent or translucent cover strip in the form of a plastic strip the result is a more diffuse and more even lighting effect, which is more appropriate for certain applications than direct light from the double ended tubular lamps.

For some particular applications it is an advantage that the lighting unit has a screen or baffle so that it is not possible to gaze directly into the double ended tubular lamps. In accordance with a still further possible form of the invention there are means for the attachment of such a screen on or in the vicinity of the ends of the limbs.

A further embodiment of the invention is to the effect that the lighting unit is provided in a device for removable attachment to mirrors, glass, pictures and the like. The removable device, which carries the lighting unit in accordance with the invention, may for instance be arranged to be attached to the thing to be illuminated by means of a clamp-like device which is clipped in place.

In order to make optimum use of the light radiated by the double ended tubular lamps and to be able to direct it onto something, in accordance with a further preferred form of the invention the inner sides of the angle strip are made reflecting like a mirror. It is however also possible to produce the angle strip of a transparent plastic so that a special effect is obtained.

Preferably the lighting unit is operated with a low voltage current in order avoid injury if the conducting tracks, terminals or the double ended tubular lamps themselves should be touched.

The invention will now be explained with reference to the drawings by way of example.

Figure 1:
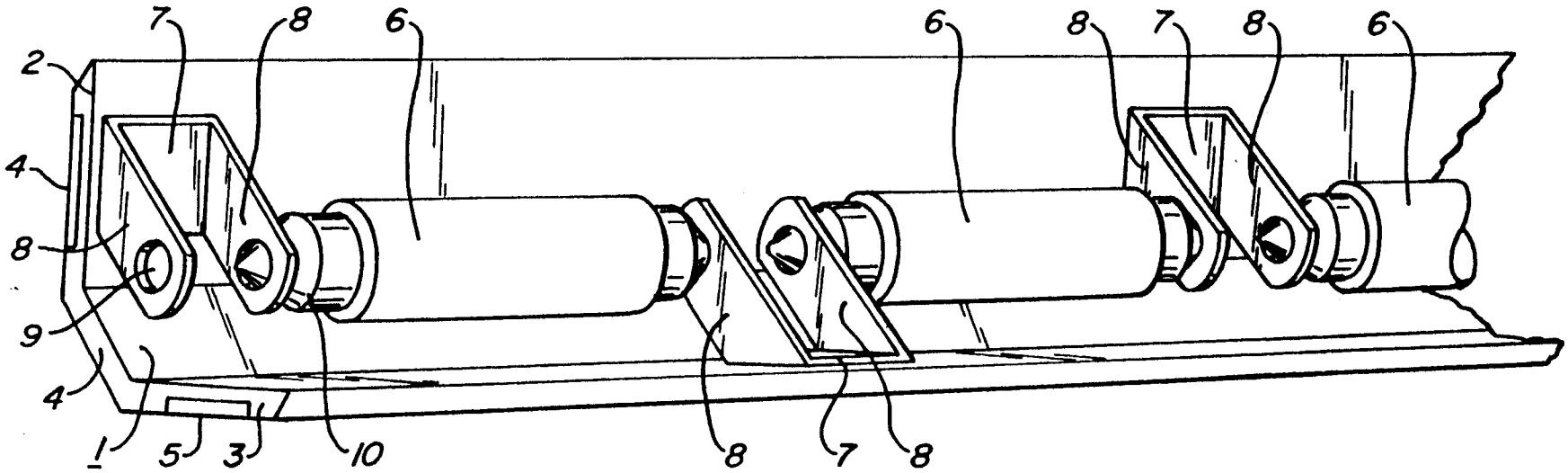
FIG. 1 shows a perspective view of one working embodiment of the invention.
Figure 2:
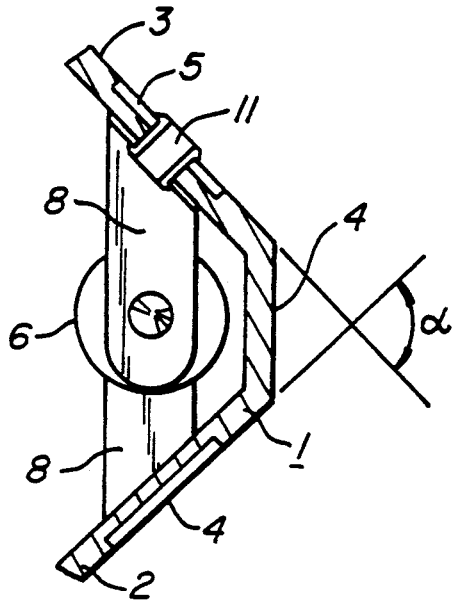
FIG. 2 shows a side view of the embodiment shown in FIG. 1.

The working example to be seen in FIG. 1 in perspective 1 and in FIG. 2 in a side view in the form of a lighting unit in accordance with the invention has an angle strip 1 which possesses two limbs 2 and 3. The limbs 2 and 3 are at an angle $\alpha$ to each other (see FIG. 2) which in the present example amounts to 90°. The limbs 2 and 3 are not continued as far as a point of intersection but are connected together by means of a transverse part 4. The angle strip consists, to take an example, of plastic material, as for instance of white or transparent Macrolon.

On the outer face of the limbs 2 and 3 conducting tracks 4 and 5 are provided for the supply of power to the double ended tubular lamps. The conducting tracks 4 and 5 extend along the full length of the strip lighting unit. In the illustrated working example of the invention the conducting tracks are let into the material of the angle strip 1 on the outer faces of the limbs 2 and 3.

On the inner faces of the limbs 2 and 3 the holding elements 7 for the double ended tubular lamps are secured, which each have two resilient lugs 8. At the outer ends of the resilient lugs 8 there are respective holes 9, which are designed with such a diameter that the conically tapering ends 10 of the double ended tubular lamps may partly extend into the hole. By pressing back the resilient lugs slightly it is possible for the double ended tubular lamps 6 to be inserted between the resilient lugs 8 of two double ended tubular lamp holding elements 7, the double ended tubular lamps 6 then being held in place by the resilient lugs.

The holding elements 7 for the double ended tubular lamps are alternately secured to the two limbs 2 and 3, respectively. The holding elements 7 are connected with the conducting tracks 4 and, respectively, 5. As will be seen from FIG. 2, the holding element 7 for a double ended tubular lamp is connected by means of a rivet 11 with the limb 3, the rivet simultaneously serving as a means for ensuring electrical contact between the conducting track 5 and the holding element 7. Preferably, the rivet 11 is countersunk into the outer face of the limb 5 (although this is not shown in FIG. 2) in order to ensure thai the outer face of the limb 3 will make flat and snug engagement with a wall which the strip lighting unit is fixed to.

The holding elements 7 are respectively alternately attached to the two limbs 2 and, respectively, 3 and are thus alternately connected with the conducting tracks 4 and, respectively, 5.

This means that the double ended tubular lamps 6 are connected together with each other in parallel so that if one of the lamps should fail or burn out the other lamps will continue to shine.

Figure 3:
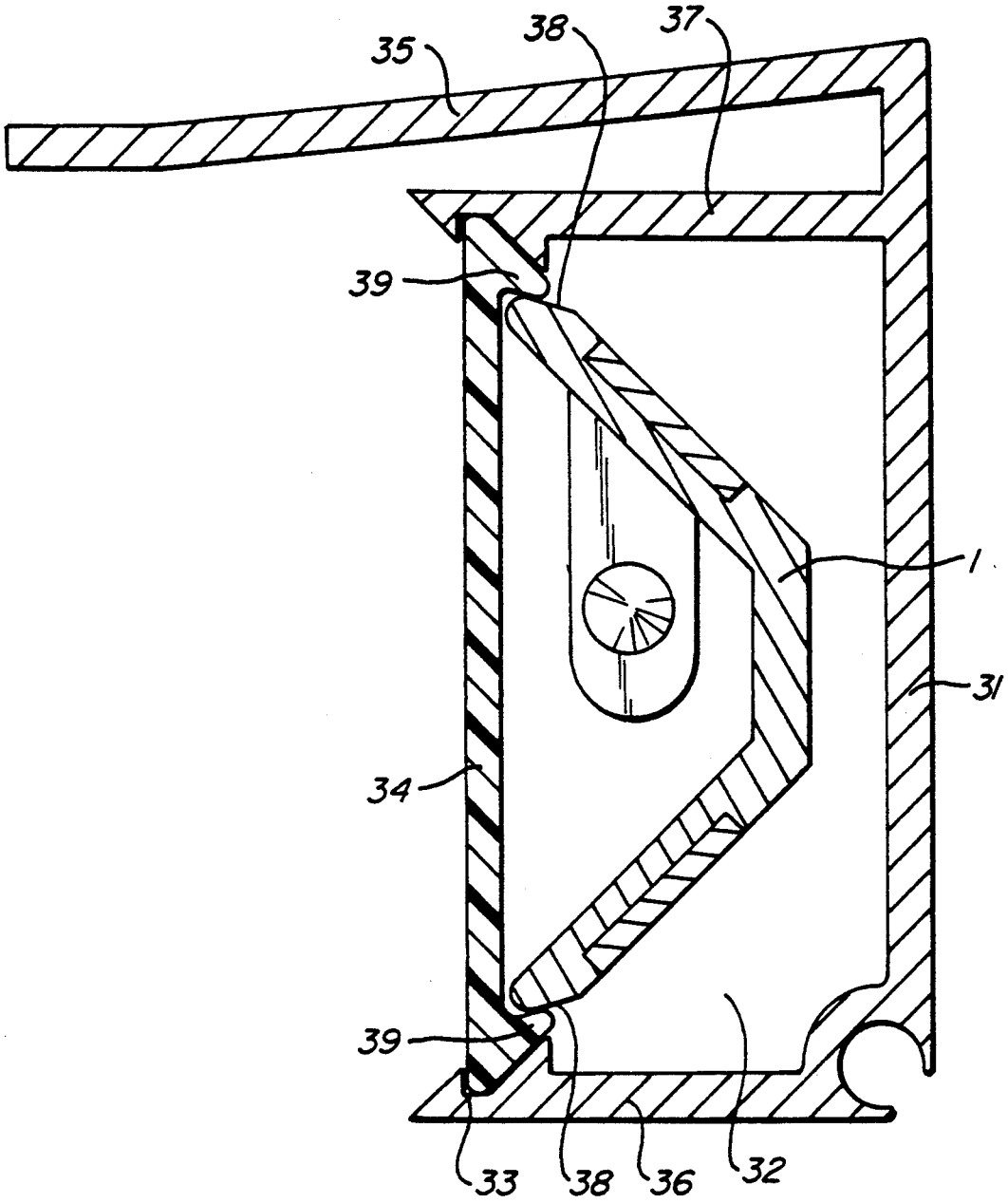
FIG. 3 shows a working example for a device, which holds the lighting unit of the invention and serves as a light fitting for a mirror.

FIG. 3 shows the application of the lighting unit in accordance with the invention in connection with a mirror lighting fixture. The fixture 31 of FIG. 3 provided therefor has a rectangular spaced opening at one longitudinal side. At the end of the two short side walls 36 and 37 of the open space 32 there are recesses 33 on the inner face to receive and hold the lighting unit in accordance with the invention.

In the case of this design of the invention there is a transparent cover strip 34, which has projections 39 between which the lighting unit is resiliently set. The ends 38 of the limbs of the lighting unit 1 are for this purpose somewhat flattened at the outer side, as is indicated in FIG. 3.

The cover strip with the lighting unit 1 clamped thereto is then elastically pressed or set in the recesses 33 in the limbs 36 and 37 of the holding device 31.

The transparent cover strip 34 shown in FIG. 3 may be used with advantage also in conjunction with the lighting unit 1, if the lighting unit 1 is attached on a holder, for instance by means of the transverse part 4 and the ends of the limbs 2 and 3 are left exposed. The transparent cover strip 34 then preferably consists of an elastic plastic so that the cover strip may be readily elastically applied to the lighting unit 1 and removed therefrom, for example in order to replace double ended tubular lamps. It is in this manner that it is simple to evolve a sort of modular system with only a few parts which the lighting unit may be adapted in the cheapest and simplest possible manner, even by a layman, to the most simple forms of application.

The cover strip may be snapped into place onto the lighting unit 1 by light pressure.

The main advantage of the present invention, that is to say that it may be supplied in the form of long lengths which are then cut to the required size so that there is a very simple adaptation to the various space and light requirements, thus remains, for even the cover strip or the holding device 31 may be cut by the user down to the required length just like the lighting unit itself.

Figure 4:
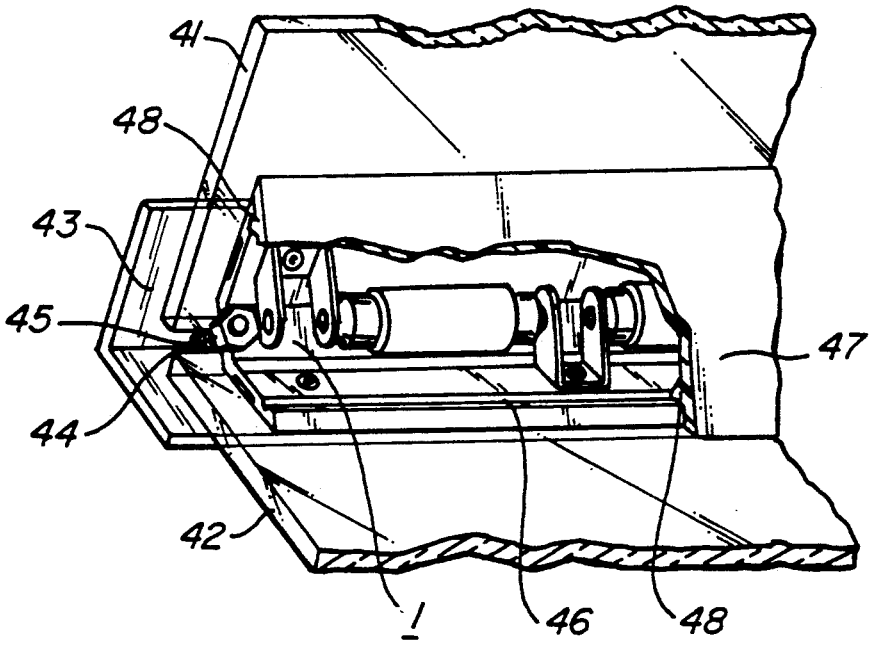
FIG. 4 shows the lighting unit of the invention the form of an angle connection.

FIG. 4 shows a particularly advantageous design and application of the lighting unit 1 in accordance with the invention for the connection of two wall elements 41 and 42 placed at an angle in relation to each other. In the illustrated form the wall elements 41 and 42 have an angle of 90°. It is however also possible to so design the lighting unit 1 that the limbs 2 and 3 of the lighting unit 1 have another angle between them, as for instance 135°, dependent on the particular application, so that the lighting unit 1 may also be used as an angle element for the connection of two wall elements, which have and angle between them other than 90°, as for instance an angle of 135°.

As shown in FIG. 4 the design and form of application is made with an isosceles external angle element 43, whose sides in the illustrated embodiment have an angle of 90°between them. The external angle element may for instance consist of metal. This external angle element is fixed with studs 44 to the lighting unit 1 in such a manner that between the external angle and the lighting unit mounted on the inside lateral grooves or slots are left, onto which the wall elements 41 and 42 may be placed and clamped in place. The wall elements 42 and 42 may, dependent on the application, be glass or mirror sheets or may be walls of some other material. As shown in FIG. 4 the studs 44 are firmly mounted with a certain spacing apart in the inner corner of the external angle 43, for example by soldering.

The lighting unit 1 is then slipped onto the studs 44, it having suitable holes for this purpose. By tightening a nut 45 the wall elements 41 and 42 are clamped firmly between the outer angle 43 and the lighting unit 1.

Naturally for other forms of attachment and other attachment devices may be conceived of by those in the art in order to use the lighting unit 1 as an angle element for the construction of cases, show cases and the like.

In the vicinity of the limb ends 2 and 3 of the lamp 1, as will be seen from FIG. 4, there are grooves 46 on the inner face for the attachment of a cover strip 47. For its part this cover strip 47 has suitable projections for the attachment in the grooves 46. The cover strip is able to be secured in a simple manner simply by pressing on and may be simply removed, if for instance a burnt out double ended tubular lamp is to be replaced.

The form of design and application shown in FIG. 4 of the lighting unit 1 may be used at a very low cost for the production of show cases and other structures, the user being left much freedom in the production of such structures. The result is optimally illuminated three dimensional structures, show cases, store window and the like for instance for decoration purposes, for which the invention is highly suitable, for instance in the case of exhibitions and store window decoration. In this respect it is of particular importance that the lighting unit is extremely small and is inconspicuous in its dimensions, a high illuminating effect nevertheless being achieved.

In accordance with one embodiment of the invention the dimensions of the strip lighting unit amount to 1.5 times 3.5 cm, the length possibly amounting to 4 m or even more. Dependent on the specific application the user may practically cut off the lighting unit from a running length of stock with adaptation to the desired form of use.

In the illustrated form of the invention 20 double ended tubular lamps are provided for every 100 cm of length, such lamps having individual wattages of 5 or 10 watts so that there is a valuege of 100 or 200 watts per 100 cm.

The lighting unit in accordance with the invention is preferably operated with a low voltage, as for example 6 v, 12 v or 24 v so that the lighting unit is more particularly suitable for rooms exposed to the outside air or damp premises. Furthermore, it is particularly suitable for nurseries.

The connection of the conducting tracks 4 and 5 with a transformer or with the line supply may for instance be by way of terminals, which are mounted at the ends of the limbs 2 and 3 and form an electrical contact with the conducting tracks 4 and, respectively, 5. In accordance with another possible form of the invention it is possible to have plugs in contact with the conducting tracks 4 and, respectively, 5 at the end of a lighting unit, such plugs then serving for the supply of power to the lighting unit. For greater lengths it is possible to connect at number of strips together with coupling terminals or plugs.

Although the invention has been described with reference to the working examples thereof and forms of application shown in the drawings, a man in the art will be able to conceive of numerous modifications, developments and applications without necessarily departing from the scope of the invention.

I claim:

1. A lighting unit for use with double-ended tubular lamps arranged in a row and having conically shaped contact ends, the lighting unit comprising an angle strip with first and second limbs forming inner faces arranged at an angle ($\alpha$) with respect to each other; first and second, electrically conductive tracks applied to at least one of the limbs and extending continuously over a length of the angle strip; electrically conductive lamp holding elements each having first and second resilient lugs including a hole adapted to receive and hold the conically tapering contact ends of the double-ended tubular lamps; rivet joints attaching the holding elements to the inner faces of the limbs forming an electrical connection between the electrically conductive tracks and the holding elements so that the holding elements attached to the limbs are alternatingly electrically connected to the first and second conductive tracks; whereby the holding elements hold and position the lamps in place and each holding element of each pair of proximate holding elements attached to the limbs is connected to a different one of the conductive tracks for supplying electrical power to tubular lamps having their conically shaped contact ends engaged by the holes in the lugs of proximate holding elements.

2. A lighting unit according to claim 1 wherein the electrically conductive tracks are applied to one of the limbs, and including electrical insulation between the tracks.

3. A lighting unit according to claim 1 wherein one electrically conductive track is applied to each of the first and second limbs.

4. A lighting unit according to claim 1 wherein the angle between the limbs is 90°.

5. A lighting unit according to claim 1 wherein the first and second limbs have outer faces facing in a direction opposite from the inner faces, and including first and second wall elements applied to the outer faces of the angle strip, and means for releasably securing the wall elements to the outer faces of the angle strip so that the wall elements have an angular orientation with respect to each other determined by the angular orientation of the limbs.

6. A lighting unit according to claim 1 including a light transmitting screen extending from a free end of the first limb to a free end of the second limb.

7. A lighting unit according to claim 6 including means defined by the limbs proximate the free ends thereof and by the screen for removably attaching the screen to the limbs.

8. A lighting unit according to claim 1 including a holder for attaching the unit to an object, the holder including first and second resilient arms arranged to resiliently engage free ends of the first and second limbs, respectively.

9. A lighting unit according to claim 8 including a light transmitting screen extending over the length of the angle strip and between free ends of the first and second limbs, and wherein the screen is disposed between the free ends of the limbs and the resilient arms of the holder.

10. A lighting unit according to claim 1 including means defining a mirror surface on the inner faces of the limbs.

11. A lighting unit according to claim 1 wherein the angle strip is made of a transparent plastic material.

12. A lighting unit according to claim 1 wherein the angle strip is made of a translucent plastic material.

13. A lighting unit according to claim 1 wherein the electrically conductive tracks, the holding elements and the rivet joints are adapted for use with tubular lamps operating at a voltage substantially less than 110 volts.

* * * * *